United States Patent [19]

Ellis

[11] Patent Number: 4,937,886

[45] Date of Patent: Jul. 3, 1990

[54] INFANT SHIRT HOLD-DOWN

[76] Inventor: Barbara S. Ellis, 8213 Aspen Way, Elkins Park, Pa. 19117

[21] Appl. No.: 292,362

[22] Filed: Dec. 30, 1988

[51] Int. Cl.[5] ..... A41F 17/00

[52] U.S. Cl. ..... 2/323; 2/325; 2/326

[58] Field of Search ..... 2/323, 325, 330, 331, 2/332, 335, 326

[56] References Cited

U.S. PATENT DOCUMENTS

| | | | |
|---|---|---|---|
| 863,970 | 8/1907 | Ebersole | 2/326 |
| 949,827 | 2/1910 | Kurtz | 2/335 |
| 1,404,719 | 1/1922 | Postl | 2/335 |
| 1,583,552 | 5/1926 | Herzberg | 2/332 |
| 1,653,288 | 12/1927 | Johnson | 2/326 |
| 2,477,302 | 7/1949 | Kennedy | 2/325 |
| 2,727,247 | 12/1955 | Bailey | 2/117 X |
| 3,711,867 | 1/1973 | Mott | 2/329 X |
| 4,596,569 | 6/1986 | Campbell | 604/387 |

FOREIGN PATENT DOCUMENTS

| | | | |
|---|---|---|---|
| 134723 | 4/1933 | Austria | 2/325 |
| 260788 | 10/1928 | Italy | 2/333 |

*Primary Examiner*—Werner H. Schroeder
*Assistant Examiner*—Jeanette E. Chapman
*Attorney, Agent, or Firm*—Volpe and Koenig

[57] ABSTRACT

An accessory for and in combination with a small child's or infant's clothing. A hold-down device of elasticized fabric comprises a relatively wide, elongated central section. A pair of straps extend from each end of the central section, each strap being provided with a selectively operable fastener at the end and with individual length adjusting means. The child wears an upper garment, as a shirt, which it is desired to restrain from riding up. The hold-down is passed between the child's legs and the strap fasteners are fastened to the lower edges of the upper garment.

8 Claims, 2 Drawing Sheets

INFANT SHIRT HOLD-DOWN

BACKGROUND OF THE INVENTION (1) Field of the Invention

This invention relates to an accessory for infant's or small children's clothing. More particularly, it relates to an accessory adapted and suitable for use an infant or child in the diaper-wearing stage. More particularly, it relates to a detachable hold-down device attached to or adapted to be attached to the lower edge or hem of a child's shirt.

The use of this invention provides a means for a child's shirt, jersey, pull-over, undershirt or similar garment from riding up. It thus contributes to a near appearance of the child. For example, it has particular but not exclusive advantageous use when the child is wearing some other garment, as a jacket or sweater over the shirt. The use of this invention also contributes to the comfort of the child in that it prevents bunching up of the shirt garment.

(2) Prior Art

It is known to have suits for infants, particularly boys, in which the top or shirt portion is buttoned to the pants portion. Such buttons are sometimes made to be decorative aspects of the combined garment. Various known snaps or other connectors may be used instead of buttons. Such expedients require that the pants and the top portion be made to have matching buttons or other fasteners, and furthermore, they do not pertain to the situation in which the child is wearing only diapers as a lower garment and has some sort of top garment for warmth or protection.

It has of course been known to provide suspenders and suspender-like devices for holding up trousers or pants. Such suspenders are known to be designed especially for use on children's trousers, as in U.S. Pat. No. 3,751,732. That patent only contemplates the concept of a suspender to hold up pants. The actual suspender straps as disclosed in that patent are not constructed or proportioned so as to be apt or usable as a shirt hold-down device, nor is there any hint of such a concept in that patent.

SUMMARY OF THE INVENTION

It is an object of this invention to provide a clothing accessory suitable for use by infants or children to prevent an upper garment from creeping up on the body.

It is another object of this invention to provide a removable hold-down suitable for use on an infant or child, to restrain an upper garment from creeping up on the body, and having applicability to any upper garment and any diaper or trouser or trouser-like lower garment.

It is another object of this invention to provide the combination of a shirt-like upper garment and a hold-down device, detachably attached to said upper garment at two points at the bottom front of said upper garment, and two points at the bottom rear of said upper garment, said hold-down device passing below a lower garment.

It is yet another object of this invention to provide a hold-down device comprising an elongated flexible relatively wide central section adapted to pass below the clothed crotch of an infant or child, and two pairs of straps, one of said pair being attached to an end of said elongated central section and the other of said pair being attached to the other end of said central section, each strap being provided with a clip means or other attaching means at the remote end thereof, and an elastic characteristic in said straps, said central portion, or both.

BRIEF DESCRIPTION OF THE DRAWINGS

The invention is best initially understood in connection with the accompanying drawings in which like reference numerals relate to like parts and in which.

DESCRIPTION OF THE PREFERRED EMBODIMENTS

Figure 1:
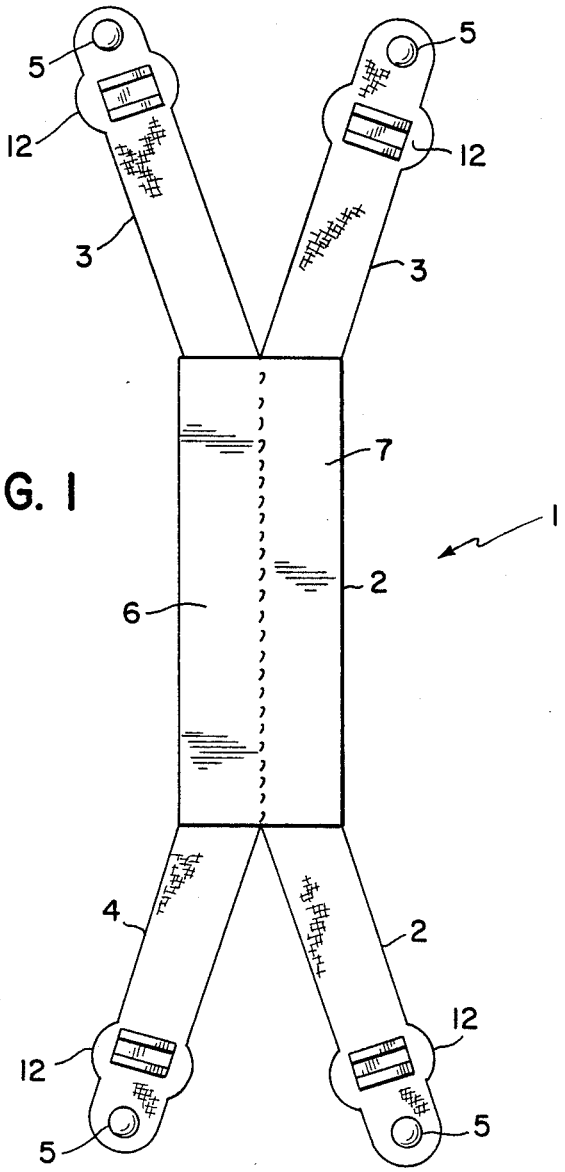
FIG. 1 is a plan view of the hold-down device in a laid out condition.

The hold-down device, generally designated 1, is shown in a plan laid out condition in FIG. 1. It comprises an elongated central section 2. For convenience in manufacture, the central section may be made of two parallel identical segments 6 and 7, sewn together along one edge of each to make the section 2, but the construction of the central section from multiple segments is not in itself critical to this invention. The central section 2 is made large enough in plan area to distribute the force loading on the child's crotch and avoid unpleasant pressure. The width of section 2 is limited by having to avoid chafing contact with the inside of the child's thighs and having to avoid restricting movement by the child. The length of section 7 is limited by having to leave enough room for the attaching straps and the attaching means and strap length adjusting means and is further limited by having to avoid reaching the lower edges of the front and rear bottom edges of the upper garment, when installed.

A typical and preferred approximate ratio of the length of the central section 2 to its width is 3 to 1. A typical and preferred approximate length of the section 2 is about 12 cm. A typical and preferred approximate width of section 2 is about 4 cm.

At an elongated end of section 2 a pair of straps 3 are affixed by sewing or other known means. As shown, the straps 3 extend from a narrow edge of section 2 in the plane of section 2, generally in the same direction as the length of section 2, but also diverging outwardly. The purpose the divergence is so that the remote or distal ends of the straps may be fastened to separate points at the lower edge of the upper garment without mutual interference of the attaching points, with the attaching points for the pair to both be on either the front or the rear of the child. The length of each strap is preferably adjustable by well-known and conventional means.

Each strap is provided at the remote or distal end thereof with selectively operable attaching means. The preferred embodiment of such means is any known and conventional clamp, clip or clasp 5. This means 5 is often referred to as a garter clip and may include a soft stud or button which may be inserted into a rigid slot, with the slot having a width varying from size wide enough to pass the stud to narrow enough to retain it. The means 5 may also be a jawed hinge clip of conventional design.

Preferably, a means for selectively varying the length of each strap is provided. This function makes it easier to fit the hold-down device 1 to children of varying sizes. Such a length adjusting means 12 may comprise a pair of transverse slots in a rigid member through which the strap is threaded and folded back on itself.

A typical and preferred approximate width of each strap is about 1.6 cm. A typical and preferred approximate length of each strap, including the fastening means, is about 8–12 cm., depending on the length adjustment.

Another pair of straps 4 are provided and fastened at the other end of central section 2. The straps 4 are the same as described above in connection with the straps 3. When one pair of straps is attached to the rear of the upper garment, the other pair is attached to the front of the upper garment.

It is preferred and highly desirable that there be some measure of elasticity in the hold-down device. In the preferred and typical embodiment, the straps 3 and 4 and the central section 2 are made of known, conventional woven elasticized cloth. Of course, some elastic characteristic of the hold-down device 1 may be obtained if either the straps or the central section is elasticized.

The typical and preferred approximate dimensions given above are understood not to exactly critically limiting. Reasonable variations are expected, and the typical cited dimensions illustrate the differentiation of this invention from known other devices, such as ordinary suspenders.

Figure 2:
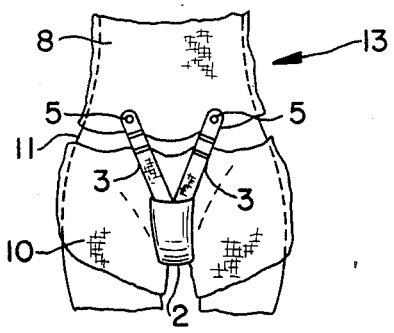
FIG. 2 is a front elevational view, partially fragmented, of a child wearing a diaper and a shirt with the hold-down device installed.
Figure 3:
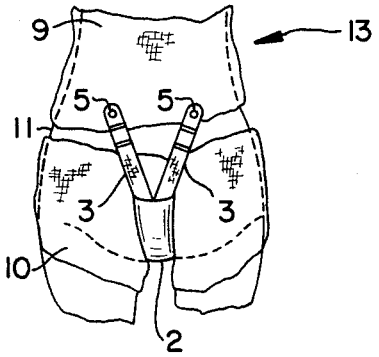
FIG. 3 is a rear elevational view, partially fragmented, of a child wearing a diaper and a shirt with the hold-down device installed.

FIG. 2 shows a child, generally designated 13, in fragmented view, taken from the front. The child wears an upper garment; the upper garment front 8 is shown. The child wears a lower garment, here represented as a diaper 10. Typically, but not necessarily, a portion of the child's waist 11 is exposed between the upper and lower garments. The hold-down device is passed between the child's legs with the central section bearing against the clothed crotch. The straps 3 are fastened to the lower edge or hem of upper garment front 8, by the fastening means 5. FIG. 3 is exactly the same as FIG. 2 except that it shows the rear of the child and the upper garment rear 9. In the same manner as described above in connection with straps 3, the straps 4 are fastened to rear 9.

It is apparent that the front and rear straps may be fastened in any order. It is also apparent that at any convenient time, the length of the straps may be adjusted if necessary to provide the desired hold-down function without exerting undue or unpleasant force on the child's crotch. Other garments, such as pants, may of course be added over a lower garment, and items such as sweaters, jackets, dresses etc. may be added over the shown upper garment. Thus, the shown upper garment, is held comfortably down to provide a neat appearance and to avoid unpleasant or uncomfortable bunching or riding up of the upper garment.

The scope of the invention is to be determined by the appended claims and not limited by the shown and described embodiment.

I claim:

1. An upper garment hold-down device comprising:

an elastic central section and two pairs of elastic straps, each of said elastic straps having a free end and an end with a fastening means thereon, each of said pair of straps affixed directly adjacent each other by sewing, at the free ends thereof, to a respective end of said central section with the straps of a respective pair diverging outwardly from each other and the central section as they extend toward the fastening means.

2. The device of claim 1 wherein each of said elastic straps is adjustable in length.

3. The device of claim 1 wherein said elastic central section has a width to length ratio of about 1 to 3.

4. The device of claim 3 wherein the device has an overall length to width ratio of about 3 to 1.

5. The device of claim 3 wherein said central section has width of approximately 4 cm. and a length of approximately 12 cm.

6. An upper garment hold-down device comprising:

an elongate central section having length-wise ends that are appropriate three times longer than its width-wise ends and two pairs of elongate elastic straps, each of said elastic straps having a free end and an end with a fastening means thereon, each of said pair of elastic straps affixed directly adjacent each other by sewing at the free ends thereof, to a respective width-wise end of said central section with the straps of a respective pair diverging outwardly from each other and the central section as they extend towards the fastening means.

7. The device of claim 6 wherein each of said elastic straps is adjustable in length.

8. The device of claim 6 wherein the device has an overall length to width ratio of about 3 to 1.

* * * * *